United States Patent [19]

LeBlon

[11] Patent Number: 4,706,547

[45] Date of Patent: Nov. 17, 1987

[54] COAXIAL MULTI-FUNCTION INSERTABLE CARTRIDGE VALVE

[76] Inventor: Hubert LeBlon, 2 Chemin de Montgeroult, 95650 Boissy L'Aillerie, France

[21] Appl. No.: 898,524

[22] Filed: Aug. 21, 1986

[30] Foreign Application Priority Data

Aug. 26, 1985 [FR] France ..... 85 12707

[51] Int. Cl.[4] ..... F15B 13/042

[52] U.S. Cl. ..... 91/420; 91/446; 91/454; 137/596.18; 137/596.2

[58] Field of Search ..... 91/420, 446, 454; 137/596.18, 596.2

[56] References Cited

U.S. PATENT DOCUMENTS 3,283,779 11/1966 Rosaen ..... 137/596.14
4,475,442 10/1984 Breeden ..... 91/446 X
4,569,272 2/1986 Taylor et al. ..... 91/420

FOREIGN PATENT DOCUMENTS 0041199 12/1981 European Pat. Off. .
0080135 6/1983 European Pat. Off. .
3048746 7/1982 Fed. Rep. of Germany .
2485104 12/1981 France .

*Primary Examiner*—Gerald A. Michalsky
*Attorney, Agent, or Firm*—Murray and Whisenhunt

[57] ABSTRACT

The invention relates to a coaxial multi-function insertable hydraulic distribution cartridge valve including various inlet and outlet ports (P1,X1,R1,S1,s1,D1,B1), a first compensating slide (N1) urged towards a position of full opening by a first spring (r1), a second internal slide (J1), concentric with the first, providing the principal regulation of the oil inlet flow rate, urged by a second spring (r2), against the control pressure delivered by the inlet port (X1), towards the position of closure of the communication between the oil pressure inlet port (P1) and the outlet port (R1) delivering the actuating pressure, and isolating (C) check valve and a backfeed (G) check valve, which are urged by a third spring (r3) to return these two check valves into the position of closure of communication towards (S1) for the check valve (C) and towards (T1) for the check valve (G), a third balancing slide (E1) urged by a fourth spring (r4), against the pressure delivered by the balancing pressure port (B1) and the pressure delivered by the actuating outlet port (R1), towards the position of closure of the communication between the actuating outlet port (R1) and the port (T1) for return of oil to the reservoir.

9 Claims, 1 Drawing Figure

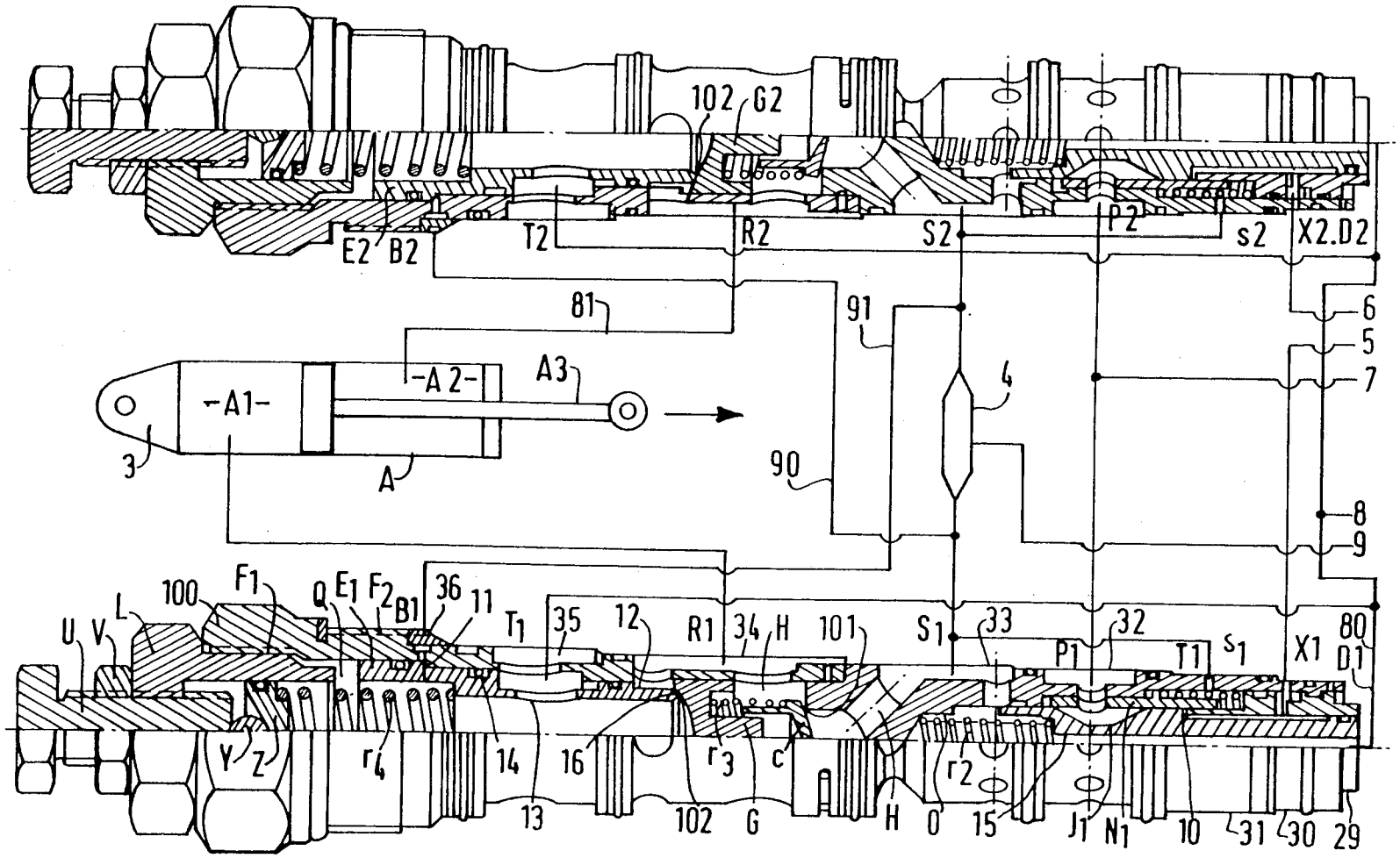
X2.D2
6
5
7
8
9
80
D1
X1
29
30
31
10
N1
J1
15
0
H
G
102
16
13
14
r4
Z
Y
L
V
U
100
F1
Q
E1
F2
B1
36
11
T1
35
12
R1
34
H
101
C
r3
r2
33
S1
4
S2
91
90
R2
T2
81
A3
-A2-
A
-A1-
3
B2
E2
G2
102
P2
s2
X2
T1
s1
32
P1

COAXIAL MULTI-FUNCTION INSERTABLE CARTRIDGE VALVE

The present invention relates to multi-function insertable cartridge valves, and their use in controlling a double-acting jack.

Said coaxial multi-function insertable cartridges constitute parallel distribution elements for hydraulic power circuits sensitive to the load, which are frequently called load-sensing control systems.

The hydraulic distribution circuits of public works and maintenance equipment, such as excavators, dredging shovel loaders, telescopic loaders etc., are becoming progressively more complex and heavy as a result of the more stringent requirements of safety standards and of the necessity of energy conservation.

A present-day distribution circuit on an excavator comprises hand operated control means for the remote guiding of distributors, distributors combining a progressively larger number of functions (distribution, excess pressure, backfeed, throttling operations), large amounts of piping, which leads to the receivers (jacks or motors), and finally safety valves and valves for the control of progressively more complex movements, such valves being incorporated in the jacks without interposition of flexible hose.

A first object of the invention is to provide a cartridge valve which may be inserted in the distribution blocks, in order to facilitate the construction and the after-sales operations, said cartridge valve including excess pressure and low pressure safety devices, in such a manner as to comply with the current requirements regarding safety and accuracy of the movements under all conditions of pressure and throughput, with a reduced cost of the equipment and of the use thereof and compatibility with a variable-throughput (load sensing circuit).

Said first object is achieved in that the coaxial multi-function insertable cartridge valve for hydraulic distribution comprises an oil inlet port, an oil return port, an inlet port for the control pressure of the valve, an outlet port providing the actuating pressure, a port for reading the actuating oil pressure, a port receiving said pressure reading, a drainage port and an inlet port for the balancing pressure, a first compensating slide urged towards a position of full opening by a first spring, a second internal slide, concentric with said first slide, providing the main regulation of the oil inlet flow rate, said second slide being urged by a second spring against the control pressure delivered by the inlet port for said control pressure towards the position of closure of communication between said inlet port for oil pressure and said outlet port delivering the actuating pressure, an isolating check valve and a backfeed check valve urged by a third spring for bringing back said two check valves into the position of closure of communication towards the oil inlet and pressure reading port in the case of the isolating check valve and towards the oil return port to the reservoir in the case of the backfeed check valve, a third balancing slide urged by a fourth spring against the pressure delivered by said inlet port for the balancing pressure and for the pressure delivered by said actuating outlet port towards the position of closure of communication between said actuating outlet port and said oil return port.

According to another feature of the invention, the various slides and check valves have coaxial axes of symmetry and are arranged in a two part cylindrical casing, including the various ports on its periphery and spaced longitudinally from one another.

According to further feature of the invention, the cylindrical casing is adapted to be accommodated in a cavity including respective bores, corresponding to the dimensions of the casing, and the portion of the casing situated in proximity to the opening of the cavity includes an external screw thread and an internal thread.

According to still another feature of the invention, a screw device for regulating the force of the fourth spring is screwed into an internal thread.

According to a further feature, the above mentioned third slide includes external bores and an internal bore for establishing communication of said return port with said actuating outlet port when the slide is disengaged from its seat under the action of the pressures in the external bores.

A final object of the invention is to use said cartridge valves for controlling a double-acting jack in a distribution circuit entirely incorporated in the jack in order to achieve a simplification of the communications for the fluid between the various elements.

Said final object is achieved in that the control of the double-acting jack is assured by two valves having oil inlet ports connected by a duct to a pump, the oil return ports being connected to a return circuit to the reservoir, control pressure inlet ports of each one of said valves being connected to the outlets of the hand-control, drainage ports being connected to one another and to the return circuit to the reservoir, the reading ports are each connected on the one hand to an inlet of a pressure priority selector, the outlet of which is connected on the one hand to a duct of the mechanism for the control of flow rate and pressure of the pump, and on the other hand with the balancing pressure inlet of the other valve, the outlet port of the first valve being connected to a first chamber actuating the rod of the jack in a direction towards the exterior, while the outlet port of the second valve is connected to a second chamber actuating the rod of the jack in a direction towards the interior.

According to another feature of the invention, the accommodating cavities of the valves may be incorporated in the jacks, and the connecting ducts are likewise incorporated in the jacks.

According to another feature of the invention, the valves may be connected to the jacks by flexible or rigid ducts.

Other features and advantages of the present invention will appear more clearly on reading the description which follows and which is given with reference to the sole figure representing two cartridge valves which are associated for actuating a jack, each one of the cartridge valves being shown in semi-section along its axis of symmetry and an outlet view in the body of the jack in which each said valves is incorporated.

For the sake of convenience, in the following description, the body of the valve-block is assimilated with the body of the jack, whether the body of the block is flanged to the body of the jack or whether it forms an integral unit therewith.

Each inlet port or element designated by a letter will bear as an index the number of the valve. Thus, control port X1 belongs to valve 1, while control port X2 belongs to valve 2. A duct 5 formed in the body 3 of control jack A connects an outlet port of the hand-control or manipulator to the control pressure inlet port X1 of valve 1. Likewise, a duct 6, which is also formed in the body of jack A, connects another outlet port of the manipulator to the control pressure inlet port X2 of valve 2. A duct 7 formed in the body of jack A connects the outlet of the pump to oil inlet ports P1, P2 of each of the two valves 1 and 2. A duct 8, which is also formed in the body of the jack A, connects a reservoir to oil return ports T1, T2 of each of the two valves 1 and 2 on the one hand, and on the other hand to drainage ports D1, D2 by ducts 80. Ports S1, S2 for reading the actuating oil pressure are each connected to the inlets of a selector 4, the outlet of which is connected to a duct 9 connected to the flow rate control inlet of the pump. Port S1 for reading the actuating oil pressure is also connected by a duct 90 to the balancing pressure inlet port B2 of the second valve 2, while port S2 for reading the actuating oil pressure of the second valve is connected by a duct 91 to the balancing pressure inlet port B1 of the first valve. Finally, the pressure reading ports S1 and S2 are also respectively connected to ports s1 and s2 conducting the oil pressure data to the pressure compensator of each valve. An outlet port R1 of the first valve delivers the actuating pressure to a first chamber A1 actuating rod A3 of the jack in an outward direction, indicated by the arrow. In another phase of operation, an outlet port R2 of the second valve 2 likewise delivers the actuating pressure to a second chamber A2 of the jack actuating rod A3 of the jack in an inward direction. Each of valves 1,2 is accommodated in the body 3 of the jack, and more particularly in cavities constituted by the succession of bores 29 to 36, which are coaxial and spaced longitudinally in the body of the jack. Bore 36 includes an internal thread, in which an external thread F2 of the casing 100 of the cartridge valve is screwed.

Said casing 100 is formed of two parts assembled between the levels of bores 33 and 34 and includes the ports indicated hereinabove, with the exception of port D1, which is located at the bottom of the cavity adapted to receive the valve. Said casing 100 includes bores adapted to receive the various slides and check valves constituting the valve and a channel H placing port R1 in communication with port S1 or port P1, depending on the position of the second slide J1.

The oil coming from pressure inlet port P1 passes first of all through the low rate regulation ports of the first slide N1 for pressure compensation, which is urged towards a position of full opening of the passage by a first spring r1, which is precharged to, say, three or six bars. The pressure arrives in the throat of slide J1 and tends to compress the opening spring of the compensator in order to reduce the flow rate of oil. On the other hand, after the oil has passed through the constriction due to the modulated position of the main slide J1, the pressure reading made at S1 will be conveyed back to s1 in order to assist the preloading spring r1 of the pressure compensator to reduce the constriction. The second slide J1, in the order of passage of the oil arriving through the pressure inlet port, is permanently urged by a second spring r2 towards a rest position, in which the chamber formed by the diameter 10 of the rear of the slide J1 and the internal bore of the compensating slide is reduced to its minimum volume. In said position, slide J1 prevents communication of port P1 on the one hand with the port S1 and on the other hand with port R1. Said slide J1 likewise includes an internal bore 15, which permits the port S1 to be placed in communication with a port D1. In a duct H, which is internal to the casing of the valve, a check valve C is permanently urged by a third spring r3 towards a closure or isolation position, in which said check valve C rests on a seat 101 which is part of the casing of the valve.

Casing 100 includes in an internal bore Q an internal thread F1, on which is mounted a threaded screw L which itself supports a unit comprising a screw U and a pinch nut V, at the end of which are mounted a ball Y and an abutment plate Z. Said abutment plate Z, which is sealed at its external diameter with the bore of the screw L, serves as the supporting point for a fourth spring r4, which permanently urges a third slide E1, referred to as a balancing slide, towards a rest position, in which the end 16 opposite to the end receiving the spring r4 is supported against the seating 102 of the backfeed check valve G. In this position of balancing slide E1, port T1 is in communication with an internal bore 14 of balancing slide E1, but any communication of this bore with port R1 is prevented. In the rest position, port B1 communicates with a chamber formed by the external bore 11 of balancing slide E1 and the internal bore of casing 100, said chamber having its minimum volume in said position. Balancing slide E1 likewise includes, in proximity to its end 16, a second external bore 12 of a diameter less than the bore in which it is accommodated and permitting the provision of an annular area, generally of one-third or one-fifth of the annular area corresponding bore 11.

In operation, when outward movement of the rod A3 of the jack is ordered by means of the manipulator, the guiding circuit pressure modulated by the manipulator between 0 and 20 bars, for example, arrives at port X1 and assures between these two pressure values a displacement of the first slide J1 between a zero course and a maximum course, modulating the oil inlet flow rate between zero and a maximum. The oil is then directed from the inlet port P1 towards the actuating outlet port R1, which is connected to the chamber A1 of the jack, which chamber is situated at the bottom of the latter in order to cause rod A3 to move in an outward direction.

Port S1 assures a pressure reading, which will be utilized by the circuit selector 4, the duct 9 and the inlet port of the oil flow rate control regulator of the self-regulating pump in order to adjust the flow rate/pressure assembly to the demand. Thus, the flow rate will be adjusted as a function of the position of the manipulator, this being a position selected by the driver of the equipment, and the pressure will be adjusted as a function of the positive or negative load. When slide J1 places port P1 in communication with duct H, the pressure exerted on isolating check valve C repels the latter and spring r3 in such a manner as to place duct H in communication with outlet port R1.

If the flow of oil in operation is checked by return of the manipulator to position 0, spring r2 of slide J1 brings back the latter, thus closing off the flow, and places reading port S1, which is isolated from outlet port R1 and from the jack by isolating check valve C, in communication with drainage port D1. As the pump no longer receives any indication of pressure on its regulator through the duct 9, the pump will be set to zero flow rate and will no longer consume any energy.

The oil which emerges from the outlet port R1 of the first valve 1 delivering the actuating pressure thus tends to cause the rod A3 of the jack to move in an outward direction in the direction indicated by the arrow. When this happens, the oil from the other side of the piston is driven from chamber A2 towards duct 81, and then towards port R2 of the second valve 2 and, when the pressure is sufficient to press the third slide E2 of the second valve 2, towards the return T2.

Closure of the return of the oil to the reservoir is thus assured by the seal between balancer E2 on seating 102 of the backfeed check valve G2 of the second valve 2. This enables the establishment of a counter-pressure which is sufficient to control the movements and to ensure that a variable load is never converted into a driving force, regardless of what may be the inlet flow rate.

Nevertheless, as will be seen hereinbelow, the balancing slide E2 of the second valve permits fulfilment of the function of maximum pressure valve and of balancing valve. In fact, balancing slide E2 tends to separate from seat 102 in counter-action against its setting spring r4, under the action of two forces (a) and (b) which are added. The first force (a) is due to the pressure fed to the port R2 and applied to the annular section of the end opposite to the spring of the balancing slide E2 of valve 2, said pressure tending to separate balancing slide E2 from its seat 102, and assures the maximum pressure valve function. The second force (b) is constituted by the pressure which is applied to the annular area corresponding to bore 11 of balancing slide E2 of the second valve. Said area is normally three to five times greater at the annular area corresponding to the excess pressure valve situated at the part opposite to the setting spring and acts to assist opening of the communication between the ports R2 and T2. Said force (b) resulting from the pressure delivered to port B2 from pressure reading port S1, constitutes the balancing valve function. In fact, under conditions of normal operation, the counter-pressure in chamber A2 and in duct 81 is low, but if the load tends to be converted into a driving force, there is no longer any pressure in chamber A1 and consequently there is also no longer any pressure at reading port S1 of valve A1 and at balancing port B2 of valve 2. The annular area of the excess pressure valve opposite the spring of the balancing slide, as well as spring r4, are calculated in such a manner that the maximum pressure induced by the load, when the latter tends to be converted into a driving force, cannot cause the displacement of balancing slide E2 in its function as excess pressure valve of valve 2, and the movement tends to stop. As the pump continues to discharge, its flow is blocked by the piston of the jack itself, which is retained by the oil in chamber A2, which is blocked by balancing slide E2. The pressure rises in chamber A1, and said pressure is reflected back through port S1 towards balancing port B2 of valve 2 and through said port B2 towards the section assisting opening, referred to as the balancing section corresponding to bore 11. This action of pressures, acting on the constriction of the return line, thus assures a counter-pressure which is always modulated. This is what is termed the balancing function.

In the event of the sudden stoppage of a movement, the kinetic energy of the moving load is converted into pressure, which will be reduced in the progressive checking of the movement by the maximum-pressure-valve function of balancing slide E2.

In the event of rupture of a flexible hose connecting the manipulators or the pump to the jacks and to the distributors constituted by the valves, there is no longer any oil pressure at ports R1 and S1 and, consequently, there is no longer any oil pressure at balancing port B2 assuring assistance in opening the outlet control valve; in this case, the movement is checked, which is indeed in conformity with the safety standards.

In the case of an action on the manipulator for the inward movement of the rod, the operation is identical, but the valve 2 becomes the control valve, while the valve 1 becomes the balancing valve.

Finally, when an external force compels a jack which is normally at rest to move (for example, to move its rod in an outward direction) balancing slide E2 permits, in its excess-pressure-valve function, evacuation of the oil between ports R2 and T2 in the direction of the movement, but this displacement causes a reduced pressure in chamber A1 and, consequently, at port R1. In this case, backfeed check valve G1 is then in an unbalanced condition and causes its spring r3 to move back in such a manner as to permit passage between ports T1 and R1 of the valve 1 in order to fill the vacuum.

Other modifications within the scope of a person skilled in the art also form part of the spirit of the invention. Thus, the two inlet and outlet control elements constituted by the first slide J and the second balancing slide E, respectively, are normally provided to operate together in a single insertable cartridge, but they may be adapted to be separated and in those circumstances to form independent insertable cartridges, one assuring the inlet control function and the other the outlet control function. In particular, the cartridge valve as described may be used in the case where the regulation of the inlet flow rate is assured by a potentiometric control converted into a hydraulic control of modulated pressure by means of a solenoid valve.

What is claimed is:

1. A coaxial multi-function insertable hydraulic distribution cartridge valve which comprises an oil inlet port, an oil return port, a control pressure inlet port for controlling said valve, an outlet port for providing oil having an actuating pressure, a pressure reading port for reading the actuating oil pressure, a pressure data receiving port for receiving the actuating oil pressure from said pressure reading port, a drainage port, and a balancing pressure inlet port, a first pressure-compensating slide urged into a position to maintain integral passage by a first spring, a second slide for regulating the oil inlet flow rate, urged by a second spring against the control pressure delivered by said inlet port, towards the position of closure of the communication between said oil pressure inlet port and said outlet port delivering the actuating pressure, an isolating check valve and a backfeed check valve urged by a third spring against the flow delivered by said oil inlet port, towards a position of closure of the communication between said outlet port and said pressure reading port, a third balancing slide urged by a fourth spring against the pressure delivered by said outlet port, towards the position of closure of the communication between said outlet port and a return port for returning the oil to a reservoir.

2. The valve as claimed in claim 1, wherein the various slides and check valves have coaxial axes of symmetry and are arranged in a cylindrical casing including said oil inlet port, oil return port, control pressure inlet port, outlet port, pressure reading port and balancing pressure inlet port, said ports being spaced longitudinally from one another along said cylindrical casing.

3. The valve as claimed in claim 2, wherein said cylindrical casing is adapted to be accommodated in a cavity including respective bores corresponding to various diameters of the casing, and the portion of the casing situated in proximity to the opening of the cavity includes fixing means.

4. The valve as claimed in claim 2 wherein said cylindrical casing includes a communication channel connecting one part of an internal bore of said casing receiving a first slide and a second slide to the internal bore receiving said check valves and a balancing slide.

5. The valve as claimed in claim 4 wherein said second slide includes an internal bore placing said drainage port in communication with said reading port for the actuating oil pressure.

6. The valve as claimed in claim 5 wherein an isolating valve and a backfeed check valve are both mounted coaxially, and in direct contact with one another and are urged in the opposite direction by one and the same spring.

7. The valve as claimed in claim 4 wherein said balancing slide has two parts of different external diameters and an internal bore, said internal bore placing said oil return port in communication with said actuating outlet port when slide is disengaged from its seating under the action of the pressure present about said parts of different diameters.

8. In a double acting jack having a movable rod, said rod being outwardly and inwardly movable, the arrangement of two valves wherein each valve comprises an oil inlet port, an oil return port, a control pressure inlet port for controlling said valve, an outlet port for providing oil having an actuating pressure, a pressure reading port for reading the actuating oil pressure, a pressure data receiving port for receiving the actuating oil, a pressure reading port for reading the actuating oil pressure, a pressure data receiving port for receiving the actuating oil pressure from said pressure reading port, a drainage port, and a balancing pressure inlet port, a first pressure-compensating slide urged into a position to maintain integral passage by a first spring, a second slide for regulating the oil inlet flow rate, urged by a second spring against the control pressure delivered by said inlet port, towards the position of closure of the communication between said oil pressure inlet port and said outlet port delivering the actuating pressure, an isolating check valve and a backfeed check valve urged by a third spring against the flow delivered by said oil inlet port, towards a position of closure of the communication between said outlet port and said pressure reading port, a third balancing slide urged by a fourth spring against the pressure delivered by said balancing pressure port, and the pressure delivered by said outlet port, towards the position of closure of the communication between said outlet port and a return port for returning the oil to a reservoir; and wherein oil delivered by a pump to a feeding duct arrives at the oil inlet ports of the two valves, respectively the oil return ports of both valves are connected to a duct for return to a reservoir, the control pressure inlet ports of each one of the valves are connected to connecting ducts connected respectively to ports of a manipulator corresponding to the control for outward movement of the rod of the jack and for inward movement of the rod of the jack, respectively, the drainage ports of both valves are connected to said duct for return to the reservoir, the pressure reading ports of both valves are each connected on the one hand to an inlet of a selector, the outlet of which is connected to a duct for controlling the throughput of the pump, and on the other hand to the balancing pressure inlet of the other valve, respectively, as well as respectively on pressure data receiving ports in each valve adapted to apply the oil pressure to said pressure-compensating slide, the outlet port of one valve being connected to a first chamber for actuating the rod of the jack in an outward direction, while the outlet port of the other valve is connected to a second chamber for actuating the rod of the jack in an inward direction towards the interior.

9. A coaxial multi-function insertable hydraulic fluid distribution cartridge valve comprising a casing;

drainage port means, disposed in said casing, for passing hydraulic fluid to a hydraulic fluid reservoir;

control pressure inlet port means, disposed in said casing, for receiving a pressurized control fluid;

oil inlet port means, disposed in said casing and having a predetermined opening, for receiving pressurized hydraulic fluid;

pressure reading port means, disposed in said casing, for supply of the pressure of said pressurized hydraulic fluid;

oil outlet port means, disposed in said casing, for discharging said pressurized hydraulic fluid;

oil return port means, disposed in said casing, for passing hydraulic fluid to a hydraulic fluid reservoir;

balancing pressure inlet port means, disposed in said casing, for receiving a balancing pressurized fluid;

oil pressure data receiving port means, disposed in said casing, for receiving said pressure of said pressurized hydraulic fluid from said pressure reading port means;

a first bore, disposed in said casing, fluidically connecting said pressure reading port means and said drainage port means;

a second bore, disposed in said casing, fluidically connecting said oil return port means and said oil outlet port means;

a duct, disposed in said casing, fluidically connecting said oil outlet port means and said pressure reading port means;

first slide means, slidably disposed within said casing, for variably inhibiting the predetermined opening of said oil inlet port means, said first slide means being slidable between a first slide position, wherein said predetermined opening is uninhibited, and a second slide position, wherein said predetermined opening is substantially closed, said first slide means being movable to said second slide position in response to the receipt of pressurized hydraulic fluid in said oil inlet port means;

first biasing means for yieldably urging said first slide means to said first slide position with a first predetermined force;

second slide means having a throat, slidably disposed within said first bore, for variably fluidically connecting said reading port means to said first bore and said oil inlet port means, said second slide means being slidable between a third slide position, wherein said pressure reading port means is fluidically connected to said first bore and said oil inlet port means is fluidically sealed, and a fourth slide position, wherein said pressure reading port means is fluidically sealed from said first bore and fluidically connected to said oil inlet port means through said throat;

second biasing means for yieldably urging said second slide means to said third slide position with a second predetermined force;

check valve means, disposed in said duct, for preventing fluid flow in said duct from said oil outlet port means to said pressure reading port means while allowing fluid flow in said duct from said pressure reading port means to said oil outlet port means, said check valve means movable between a valve open position and a valve-closed position;

third biasing means for yieldably urging said check valve means to said valve closed position with a third predetermined force;

third slide means, slidably disposed in said second bore, for variably fluidically connecting said outlet port means and said oil return port means, said third slide means movable between a fifth slide position, wherein said oil outlet port means is fluidically sealed from said second bore, and a sixth slide position, wherein said oil outlet port means is in fluidic connection with said second bore, said third slide means being movable to said sixth slide position in response to pressurized hydraulic fluid in said oil outlet port means;

fourth biasing means for yeildably urging said third slide means to said fifth slide position with a fourth predetermined force;

wherein said control pressure inlet port means is operatively connected to said second slide means so that pressurized control fluid received by said control pressure inlet port means acts to move said second slide against said second biasing means;

wherein said oil pressure data receiving port means is operatively connected to said first slide means so that said pressure of said pressurized hydraulic fluid received by said oil pressure data receiving port means acts to move said first slide means to said first slide position;

wherein said balancing pressure inlet port means is operatively connected to said third slide means so that said balancing pressurized fluid received by said balancing pressure inlet port means acts to move said third slide against said fourth biasing means.

* * * * *